US006175710B1

(12) United States Patent
Kamaji et al.

(10) Patent No.: US 6,175,710 B1
(45) **Date of Patent: *Jan. 16, 2001**

(54) ELECTROPHOTOGRAPHIC RECORDING APPARATUS USING DEVELOPING DEVICE WITH ONE-COMPONENT TYPE DEVELOPER AND HAVING COMBINATION OF CHARGE INJECTION EFFECT AND CONDUCTIVE CONTACT TYPE CHARGER

(75) Inventors: Hideki Kamaji; Masae Ikeda; Kazunori Hirose; Hiroshi Nou; Masahiro Wanou; Teturou Nakashima; Masatoshi Kimura, all of Kawasaki; Yukio Nishio, Kurume, all of (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/178,439

(22) Filed: Jan. 6, 1994

Related U.S. Application Data

(63) Continuation of application No. 07/909,405, filed on Jul. 6, 1992, now abandoned.

(30) Foreign Application Priority Data

Jul. 6, 1991 (JP) ..... 3-166005

(51) Int. Cl.[7] ..... G03G 15/08; G03G 15/16

(52) U.S. Cl. ..... 399/284; 399/313; 399/314; 399/175

(58) Field of Search ..... 355/271, 274, 355/259, 219, 245, 284; 399/274, 270, 313, 314, 175, 285

(56) References Cited

U.S. PATENT DOCUMENTS

| | | | | |
|---|---|---|---|---|
| 4,382,420 | * | 5/1983 | Ohnuma et al. | 118/651 |
| 4,706,320 | | 11/1987 | Swift | 15/1.5 |
| 4,959,688 | | 9/1990 | Koitabashi | 355/219 |

(List continued on next page.)

FOREIGN PATENT DOCUMENTS

| | | |
|---|---|---|
| 0 323 252 | 7/1989 | (EP) . |
| 0 338 546 | 10/1989 | (EP) . |
| 0 388 191 | 9/1990 | (EP) . |

(List continued on next page.)

OTHER PUBLICATIONS

Patent Abstracts of Japan, JP–A–61 062 079 (Fuji Xerox) Mar. 29, 1986, Abstract.

Patent abstracts of Japan, vol. 10, No. 225 (P–484)(2281) Aug. 6, 1986, Abstract.

*Primary Examiner*—Richard Moses
(74) *Attorney, Agent, or Firm*—Staas & Halsey

(57) ABSTRACT

An electrophotographic recording apparatus includes a photosensitive drum on which an electrostatic latent image can be written, a developing device for developing the latent image of a charged visible image with a one-component developer, and a transferring device for electrostatically transferring the charged visible image from the drum to a sheet or paper. The developing device has a conductive foam rubber roller for entraining the developer to form a developer layer therearound and for bringing the layer to the drum for the development of the latent image, a conductive blade resiliently engaged with the foam rubber roller for uniformly regulating a thickness of the developer, and an electric source for applying electric energy to the blade to electrically charge the developer layer by a charge-injection effect. The transferring device has a conductive foam rubber transfer roller in contact with the drum, and an electric source for applying energy to the transfer roller to give a paper an electric charge having a polarity opposite to that of the charged visible image during a passage of a recording medium through a nip between the drum and the transfer roller.

50 Claims, 8 Drawing Sheets

U.S. PATENT DOCUMENTS

| | | | | |
|---|---|---|---|---|
| 4,967,231 | * | 10/1990 | Hosoya et al. | 355/219 |
| 4,989,037 | | 1/1991 | Nagatsuna | 355/200 |
| 5,062,385 | * | 11/1991 | Nishio et al. | 118/653 |
| 5,148,219 | * | 9/1992 | Kohyama | 355/219 |
| 5,164,773 | * | 11/1992 | Nishio et al. | 355/245 |

FOREIGN PATENT DOCUMENTS

| | | |
|---|---|---|
| 0 388 233 | 9/1990 | (EP) . |
| 0 404 561 | 12/1990 | (EP) . |
| 0 411 891 | 2/1991 | (EP) . |

* cited by examiner

ELECTROPHOTOGRAPHIC RECORDING APPARATUS USING DEVELOPING DEVICE WITH ONE-COMPONENT TYPE DEVELOPER AND HAVING COMBINATION OF CHARGE INJECTION EFFECT AND CONDUCTIVE CONTACT TYPE CHARGER

This application is a continuation, of application Ser. No. 07/909,405, filed Jul. 6, 1992, now abandoned.

BACKGROUND OF THE INVENTION

1) Field of the Invention

The present invention relates to an electrophotographic recording apparatus such as a copying machine, a laser printer or the like, and in particular, relates to an improvement of such an electrophotographic recording apparatus in which a one-component developer is used for recording an image.

2) Description of the Related Art

In an electrophotographic recording apparatus, the following processes are typically carried out:

a) a uniform distribution of electrical charges is produced on a surface of an electrostatic latent image carrying body;

b) an electrostatic latent image is formed on a charged area of the body surface by an optical writing means such as a laser beam scanner, an optical projector or the like;

c) the latent image is developed as a visible image with a developer or toner, which is electrically charged to be electrostatically adhered to the latent image zone;

d) the developed toner image is elect ostatically transferred from the body to a sheet of paper; and e) the transferred toner image is fixed on the sheet of paper by a toner image fixing means such as a heat roller.

Typically, the electrostatic latent image carrying body may be an electrophotographic photoreceptor, usually formed as a drum and called a photosensitive drum, having a cylindrical conductive substrate and a photoconductive insulating film bonded to a cylindrical surface thereof. In general, the charged area on the drum is produced by an electric discharger such as a corona discharger, and this type of discharger is also used for the transfer of the developed toner image from the drum to the paper.

As one type of developer, a two-component developer, which is well known, is composed of a toner component (colored fine synthetic resin particles) and a magnetic component (magnetic fine carriers). Note, typically the toner particles have an average diameter of about 10 $\mu$m, and the magnetic carriers have a diameter ten times larger than the average diameter of the toner particles. Usually, a developing device using this type developer includes a vessel for holding the two-component developer, wherein the developer is agitated by an agitator provided therein. This agitation causes the toner particles and the magnetic carriers to be subjected to triboelectrification, whereby the toner particles are electrostatically adhered to each of the magnetic carriers. The developing device also includes a magnetic roller provided within the vessel as a developing roller in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to the surface of the drum for the development of the electrostatic latent image formed thereon.

In this developing process, a quality of the developed toner image, and therefore the recorded toner image, greatly depends upon an amount of electric charges of the toner, and the amount of electric charges is governed by environmental factors, especially, a temperature and air moisture content. In general, under a low temperature and low air moisture content, the electric charges of the toner become larger, whereas under a high temperature and high air moisture content, the amount of charges of the toner become smaller. When the toner is excessively charged, a density of the toner image is lowered to thereby cause a deterioration of the recorded toner image. On the contrary, as the charges of the toner become smaller, the density of the toner image becomes higher, but an electrophotographic fog appears as a stain on the sheet or paper when the charges of the toner are too small.

A one-component developer is also known, which is composed of only a toner component (colored fine synthetic resin particles), and there are two types of the one-component developer; a magnetic type and a non-magnetic type. Namely, each toner particle of the magnetic type one-component developer has a resin part and a magnetic fine power part, whereas each particle of the non-magnetic type one-component developer has only a resin part. A developing device using the magnetic type one-component developer is also provided with a magnetic roller, which can be constructed in substantially the same manner as that for the two-component developer. Namely, the magnetic type one-component developer also can be brought to the surface of the photosensitive drum by the rotating magnetic roller as in the developing device using the two-component developer. In a developing device using the non-magnetic type one-component developer, a conductive elastic roller, which may be formed of a conductive foam rubber material, is used as a developing roller. When the conductive elastic roller is rotated within a body of the developer held by a vessel, the toner particles are frictionally entrained to be brought to the surface of the photosensitive drum.

In the developing device using the one-component developer, it is always necessary to bring the toner on the drum to a uniform thickness before an even development of the latent image can be obtained. Namely, a uniform layer of the toner must be formed around the developing roller. To this end, the developing device is provided with a blade member engaged with the surface of the developing roller, to uniformly regulate a thickness of the toner layer formed therearound. The blade member also serves to electrically charge the toner particles by a triboelectrification therebetween. In this case, a material of the blade member is selected such that the toner is charged with a desired polarity. Nevertheless, a charging characteristic of the one-component developer is also affected by a temperature and air moisture content. Generally, the one-component developer is liable to have a low electric charge under the triboelectrication with the blade member, and thus an electrophotographic fog may appear even under normal temperature and normal air moisture content.

The conventional electrophotographic recording apparatus also involves a problem to be solved in the toner image transferring process. The electric discharger used in this process gives the sheet or paper an electric charge having a polarity opposite to that of the developed toner image, whereby the toner image is electrostatically transferred from the photosensitive drum to the paper. A quality of the transferred toner image, and therefore the recorded toner image, depends upon a toner transfer efficiency, and this toner transfer efficiency is also governed by a temperature and air moisture content. Note, the toner transfer efficiency is defined as a ratio of an amount of the transferred toner to a total amount of the toner held by the drum. As the temperature and air moisture content is higher, the toner transfer efficiency is reduced so that a density of the transferred toner image, and therefore the recorded toner image, is lowered.

Furthermore, the electric discharger used in the toner transferred process has an inherent defect in that ozone is produced during the energizing thereof. Not only is ozone injurious to the health, but also it causes a premature deterioration of the photosensitive drum and other parts of the printer. Also, the use of the electric dischargers results in an increase in the production cost of the recording apparatus, because it must be provided with a high voltage electric power source for the electric discharger and an ozone filter for preventing an ozone leakage. Of course, this is also true for the electric discharger used to produce an electrically charged area on the photosensitive drum.

SUMMARY OF THE INVENTION

An object of the present invention is to provide an electrophotographic recording apparatus using the one-component developer, which is improved such that a reasonable quality of the recorded toner image can be obtained under a high temperature and high air moisture content.

Another object of the present invention is to provide such an electrophotographic recording apparatus as mentioned above, in which a production of ozone can be completely eliminated.

In accordance with one aspect of the present invention, there is provided to an electrophotographic recording apparatus comprising: an electrostatic latent image carrying body means on which an electrostatic latent image can be formed; a developing means for electrostatically developing the electrostatic latent image of the body means a charged visible image with an electrostatically-charged one-component developer; and a transferring means for electrostatically transferring a charged image developed by the developing means from the body means to a recording medium. The developing means includes a conductive developing roller member for entraining the developer to form a developer layer therearound and for bringing the developer layer to the body means for the development of the latent image, a conductive regulating blade member resiliently engaged with the developing roller for uniformly regulating a thickness of the developer layer formed therearound, and an electric source for applying an electric energy to the regulating blade member to electrically charge the developer layer by a charge-injection effect. The transferring means includes a conductive transfer roller member in contact with the body means, and an electric source for applying an electric energy to the conductive transfer roller member to give the recording medium an electric charge having a polarity opposite to that of the charged visible, during a passage of the recording medium through a nip between the body means and the conductive transfer roller member.

In the electrophotographic recording apparatus as mentioned above, the body means is preferably formed as a photosensitive body means on which an electrically-charged area can be produced for the formation of the latent image. In this case, a charger means should be provided for producing the electrically-charged area on the photosensitive body means, the charger means being constituted as a conductive contacting type charger means. The conductive contacting type charger means may comprise a conductive rotary type brush charger. Preferably, the developing roller member is formed as a conductive foam rubber roller member, and the regulating blade member is also formed as a conductive stainless steel plate member. Also, the conductive transfer roller member may be formed as a conductive foam rubber roller member.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Figure 1:
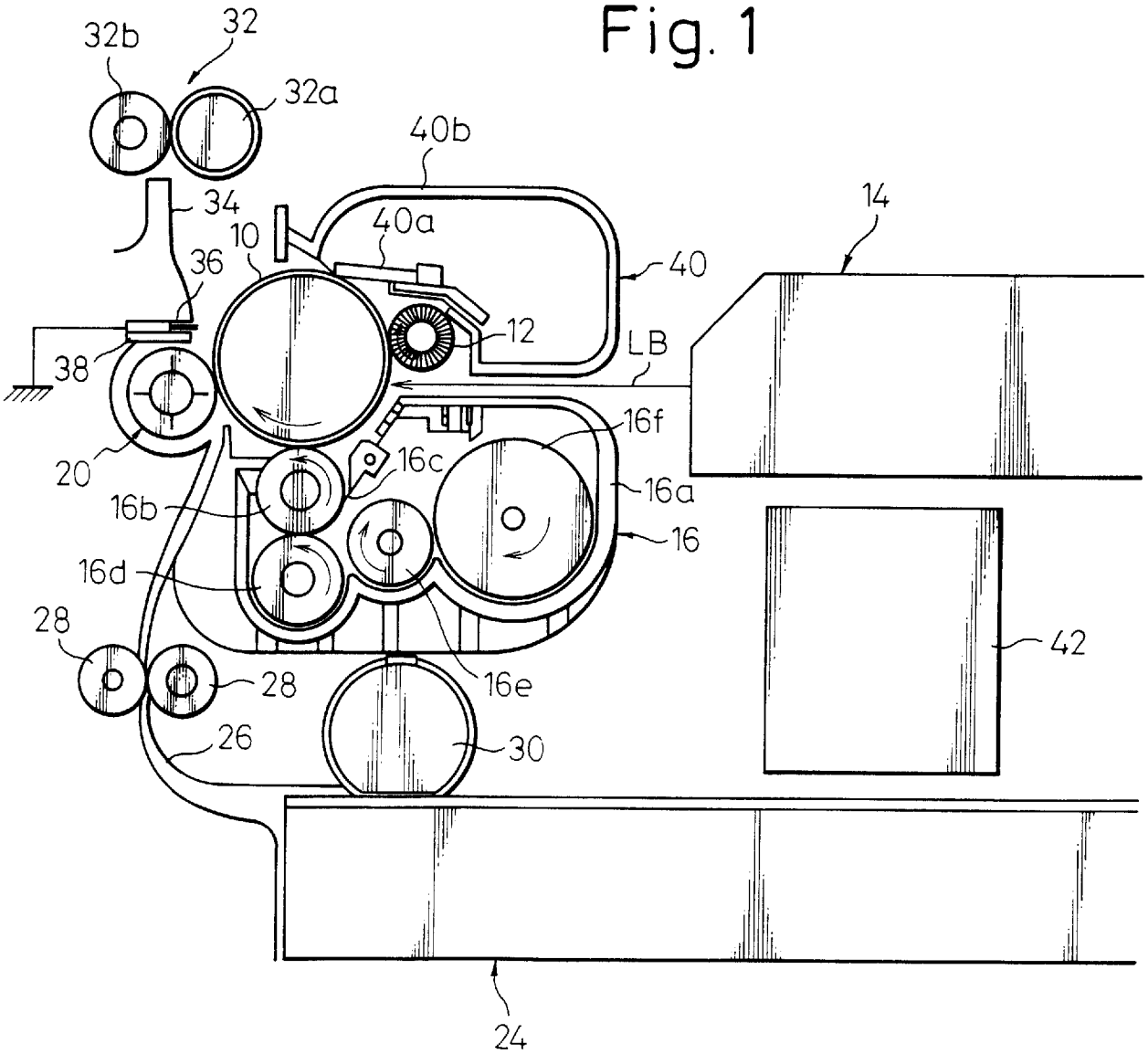
FIG. 1 is a schematic longitudinal cross-sectional view showing an electrophotographic laser printer according to the present invention.

FIG. 1 schematically shows a laser printer as an example of an electrophotographic laser printer according to the present invention. This printer comprises a rotary photosensitive drum 10 as a latent image carrying body, which is rotated in a direction indicated by an arrow in FIG. 1 during an operation of the printer. In this embodiment, the drum 10 is formed of an aluminum cylindrical hollow body and a photoconductive film composed of an organic photoconductor (OPC) and bonded to a surface of the hollow body. For example, the drum 10 may have a diameter of 40 mm, and is driven at a peripheral speed of 70 mm/s.

The printer also comprises a conductive rotary brush type charger 12 for producing a charged area on the drum 10, which may be formed of a plurality of conductive rayon filaments, available as REC-B from Yunichika K. K, and which is rotated in a direction indicated by an arrow in FIG. 1 such that the free ends of the filaments are in contact with the photosensitive drum 10. In this embodiment, the brush charger 12 has a diameter of about 16 mm, and is rotated at a peripheral speed of more than 56 mm/s. Also, the conductive rayon filaments of the brush charger 12 are implanted at a density of 100,000 F/inch$^2$, and each filament has a length of about 4 mm and a resistivity of $10^{12}$ Ωcm. The brush charger 12 is subjected to an application of an electric energy consisting of an alternating current having a frequency of 500 Hz and a peak-to-peak voltage of 1.0 kV, and a direct current offset voltage of −600 V, so that a charged area having a potential of about −600 V is produced on the surface of the drum 10. Note, another contacting type charger such as a conductive stationary type brush charger, a conductive elastic blade type charger, and a conductive elastic roller type charger, etc., may be substituted for the brush charger 12.

The printer further comprises a laser beam scanner 14 producing for an electric latent image on the charged area of the drum 10, which includes a laser source such as a semiconductor laser diode for emitting a laser, an optical system for converting the laser into a laser beam LB, and an optical scanning system, such as a polygon mirror, for deflecting the laser beam LB along a direction of a central axis of the drum 10 so that the charged area of the drum 10 is scanned with the deflecting laser beam LB. During the scanning, the laser beam LB is switched on and off on the basis of binary image data obtained from, for example, a word processor, personal computer or the like, so that an electrostatic latent image is written as a dot image on the charged area of the drum 10. In particular, when a zone of the charged area is irradiated by the laser beam LB, the charges are released from the irradiated zone so that a potential thereof is changed from about −600 V to about −100 V, whereby the latent image is formed as a potential difference between the irradiated zone and the remaining zone.

Furthermore, the printer comprises a toner developing device 16 including a vessel 16*a* for holding a non-magnetic type one-component developer, and a developing roller 16*b* provided within the vessel 16*a* in such a manner that a portion of the developing roller 16*b* is exposed therefrom and faces the surface of the photosensitive drum 10. For example, the developer is composed of a polyester resin-based toner having a resistivity of $4\times10^{14}$ Ωcm, and an average diameter of toner particles is 12 μm. The developing roller is rotated in a direction indicated by an arrow in FIG. 1, and frictionally entrains the toner particles to form a developer or toner layer therearound, whereby the toner particles are brought to the surface of the drum 10 for a development of the latent image formed thereon. Note, the developing roller 16*b* has a peripheral speed of about 170 mm/s. In this embodiment, the developing roller 16*b* is preferably formed of a conductive foam rubber material such as a conductive polyurethane foam rubber material available as Rubicell (phonetically translated) from Toyo Polymer K.K. Note, this polyurethane foam rubber material has a plurality of pore openings or cells having an average diameter of about 10 μm, a density of 200 cells/inch, an Asker hardness of 23 degs., and a resistivity of about from $10^4$ to about $10^7$ Ωcm. The developing roller 16*b* formed of the polyurethane foam rubber material has an excellent property for entraining the toner particles and is very soft, so that it can be pressed against to the drum 10 at a linear pressure of about 30 gf/cm.

Figure 2:
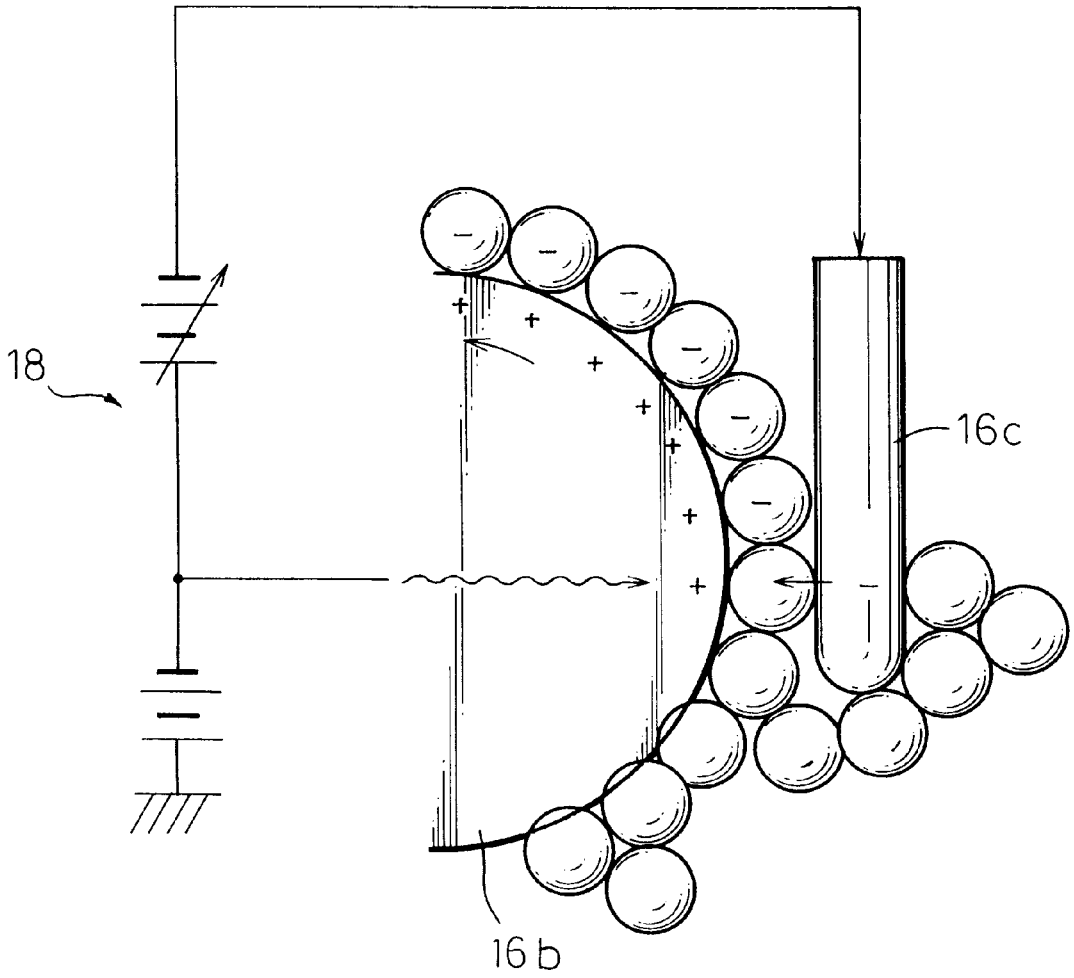
FIG. 2 is a diagrammatic view showing a part of the printer shown in FIG. 1.

The developing device 16 also includes a blade member 16*c* engaged with a surface of the developing roller 16*b* to produce a uniform thickness of the toner layer formed therearound, whereby an even development of the latent image can be ensured. The blade member 16*c* is formed of a conductive material such as metal, and is supported by the vessel 16*a* such that the blade member 16*c* is resiliently pressed against the developing roller. In this embodiment, the blade member 16*c* is made of a stainless steel plate having a thickness of 0.1 mm, and a free edge end thereof, which is in engagement with the developing roller surface, is rounded so as to give a smooth surface to the regulated toner layer. According to the present invention, the blade member 16*c* is connected to a voltage source 18 to electrically charge the toner particles by a charge-injection effect, as schematically shown in FIG. 2. In this embodiment, a voltage of about −400 V is applied to the blade member 16*c* so that the toner particles are negatively charged. Note, in FIG. 2, the toner particles are symbolically shown by an open circle, and the negatively-charged toner particles are distinguished from other toner particles by adding a negative symbol "−" thereto.

During the developing process, the developing roller 16*b* is subjected to a developing bias voltage −300 V, the negative charged toner particles are electrostatically adhered to only the latent image zone having the potential of about −100 V, as if the latent image zone is charged with the negative particles. Namely, the adherence of the negative toner particles to the latent image zone is performed in such a manner that the potential (about −100 V) of the latent image zone is returned to the potential (—about 600 V) of the remaining zone. Accordingly, if an amount of charges of the toner particles is smaller, a density of the developed toner image becomes higher. On the contrary, if an amount of charges of the toner particles is larger, a density of the developed toner image becomes lower.

The developing device 16 further includes a toner-removing roller 16*d* rotatably provided within the vessel 16*a* and in contact with the developing roller 16*b* in such a manner that a contact or nip width of about 1 mm is obtained therebetween. The toner-removing roller 16*d* is rotated in the same direction as the developing roller 16*b*, as indicated by an arrow in FIG. 1, so that the surfaces of the rollers 16*b* and 16*d* rub against each other in the counter directions at the contact zone therebetween, whereby residual toner particles not used for the development of the latent image are mechanically removed from the developing roller 16*b*. The toner-removing roller 16*d* also serves to feed the toner particles to the developing roller at one side of the nip therebetween (i.e., the right side in FIG. 1), because the toner particles entrained by the toner-removing roller 16*d* are moved toward the nip between the rollers 16*b* and 16*d*. The toner-removing roller 16*d* is preferably formed of a conductive polyurethane foam rubber material, available from Bridgestone K.K., which may have a density of 40 cells/inch, and a resistivity of about from $10^4$ Ωcm. A voltage of about −400 V may be applied to the toner-removing roller 16*d* to thereby prevent a penetration of the toner particles thereinto.

The developing device 16 may be provided with a paddle roller 16*e* and an agitator 16*f* rotated in directions by arrows in FIG. 1, respectively. The paddle roller 16*e* serves to move the toner particles toward the developing roller 16*d*, and the agitator 16*f* agitates the body of the toner to eliminate a dead stock thereof from the vessel 16*a*.

Figure 3:
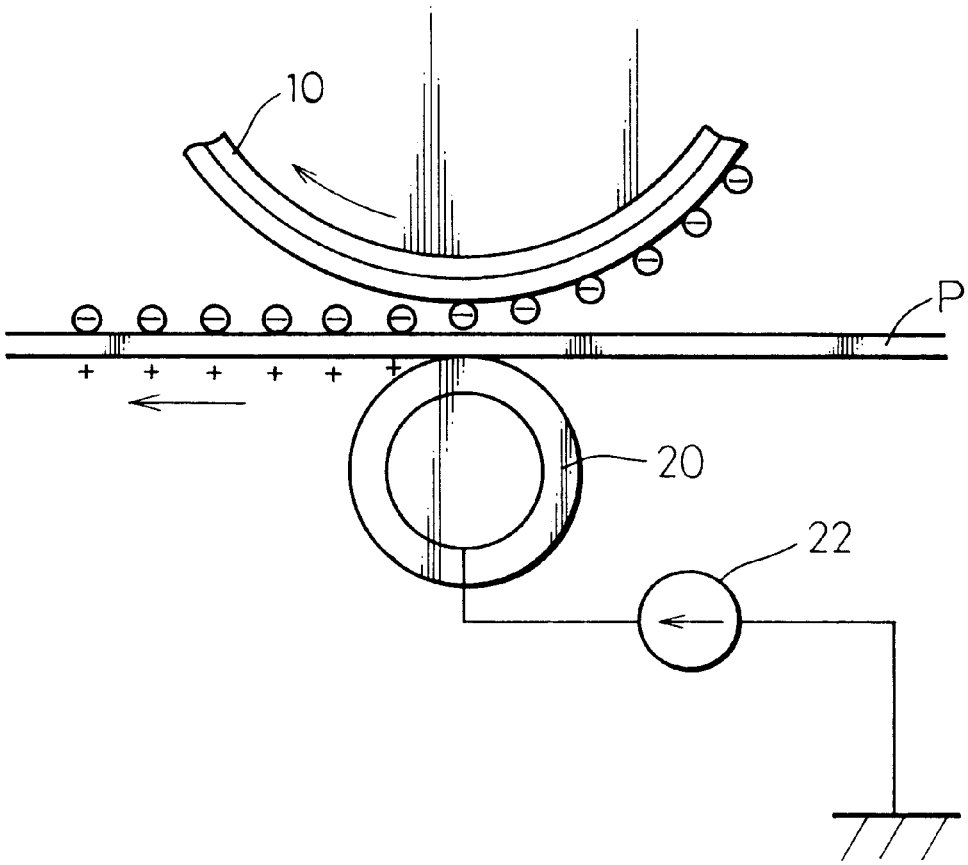
FIG. 3 is a diagrammatic view showing another part of the printer shown in FIG. 1.

Furthermore, the printer comprises a conductive roller type transfer charger 20 for electrostatically transferring the developed toner image to a sheet or paper. The transfer charger or conductive transfer roller 20 may be formed of substantially the same material as the developing roller 16*b*. Namely, in this embodiment, the transfer roller 20 is made of the conductive polyurethane foam rubber material having a plurality of pore openings or cells having an average diameter of about 10 μm, a density of 200 cells/inch, an Asker hardness of 23 degs., and a resistivity of about about $10^7$ Ωcm. The transfer roller 20 is resiliently pressed against the drum 10 at a linear pressure of about 50 gf/cm, and is connected to a transferring power source 22, as shown in FIG. 3, so that positive charges are supplied to the paper P, whereby the negatively-charged toner image can be electrostatically attracted to the paper P. Note, in FIG. 3, the negatively-charged toner particles of the developed toner image are symbolically shown by an open circle to which a negative symbol "−" is added, and the positive charges supplied to the paper P are indicated by a positive symbol "+". In this embodiment, the transferring power source 22 is constituted as a constant direct current source, so that a stable transfer of the developed toner image to the paper P is ensured, because a constant transfer charge density can be thus always given to the paper P.

The printer further comprises a paper cassette 24 in which a stack of papers is received, and a paper guide 26 extended from the paper cassette 24 toward a nip between the drum 10 and the transfer roller 20, and a pair of register roller 28, 28. During the printing operation, papers to be printed are fed one by one from the paper cassette 24 into the paper guide 26 by driving a paper feed roller 30 incorporated in the paper cassette 24. The fed paper is once stopped at the register roller 28, and is then introduced into the nip between the drum 10 and the roller 20 at a given timing, so that the developed toner image can be transferred to the paper in place.

The paper discharged from the nip between the drum 10 and the roller 20, i.e., the paper P carrying the transferred toner image (FIG. 3), is then moved toward a toner image fixing device 32 along a paper guide 34 extended between the transfer roller 20 and the fixing device 32, and is passed through a nip between a heat roller 32*a* and a backup roller 32*b* of the fixing device 32, whereby the transferred toner image is thermally fused and fixed on the paper.

As shown in FIG. 1, a grounded brush 36 is supported by the paper guide 34 in the vicinity of the transfer roller 20, and the paper comes into contact with the grounded brush 36 as soon as it is discharged from the nip between the drum 10 and the transfer roller 20, whereby a part of the positive charges of the paper escapes to the ground and thus the paper can be easily separated from the drum 10. Also, an electric insulation plate 38 is provided between the transfer roller 20 and the grounded brush 36, for preventing an electric discharge therebetween.

In FIG. 1, reference number 40 indicates a toner cleaner associated with the drum 10, which includes a scraper blade 40*a* for removing residual toner particles not transferred from the drum 10 to the paper, and a vessel 40*b* for receiving the removed toner particles. Also, in FIG. 1, reference numeral 42 indicates an electric power device, illustrated as a block, in which the electric sources 18 and 22 and other electric sources are included.

Figure 4:
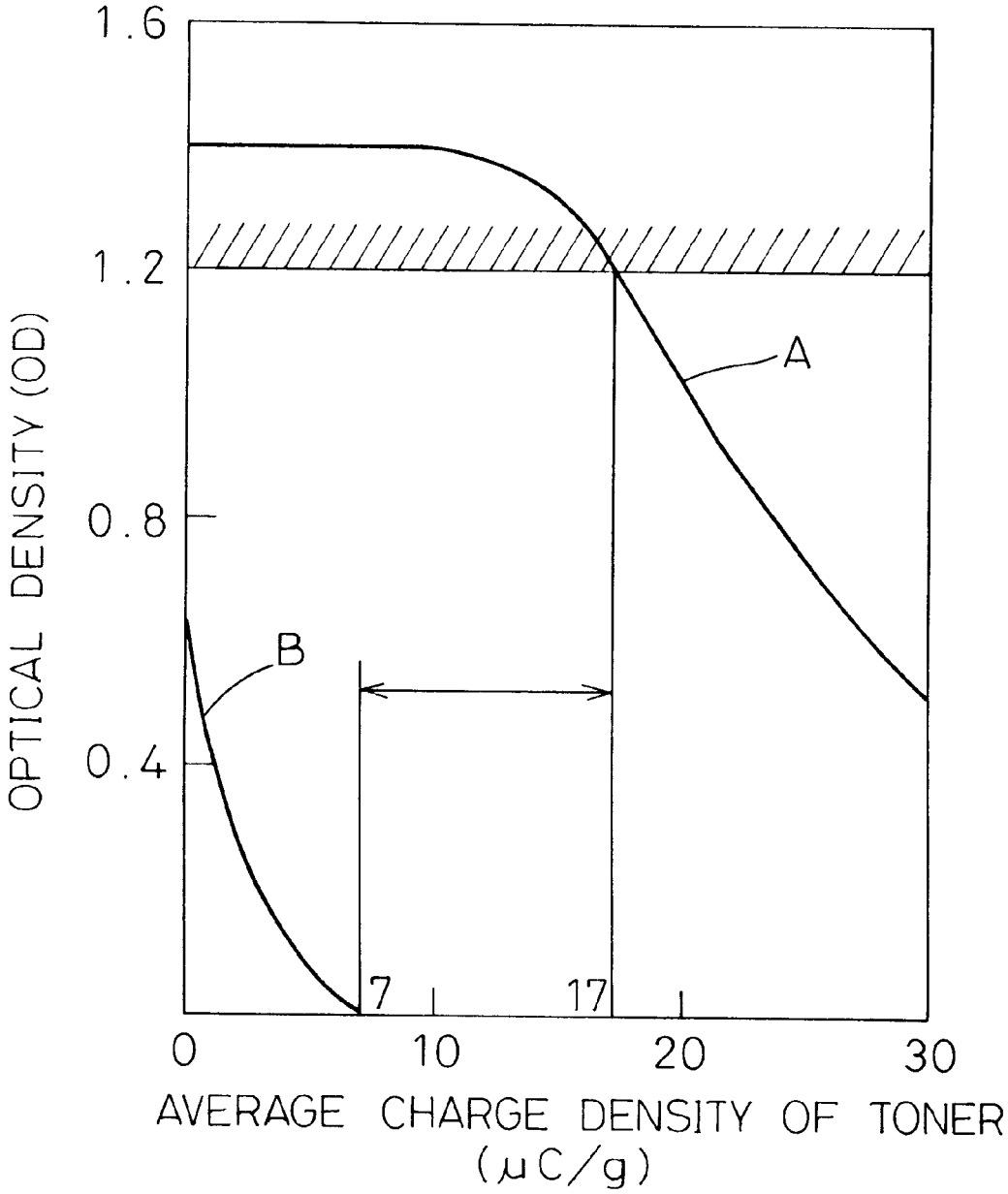
FIG. 4 is a graph showing a relationship between an average charge density ($\mu$C/g) of a toner and an optical density (OD) of a developed toner image and an optical density of electrophotographic fog.

FIG. 4 is a graph showing a relationship between an average charge density (μC/g) of a toner and an optical density (OD) of a developed toner image and an optical density of electrophotographic fog. In this graph, a curve A represents an optical density of a developed toner image, and a curve B represents an optical density of electrophotographic fog. When an average charge density of the toner is more than 17 μC/g, an developed toner image has an optical density of less than 1.2. This is because, as the charges of the toner become larger, a charging of an latent image zone can be saturated with a smaller amount of the toner, as discussed hereinbefore. On the other hand, when an average charge density of the toner is less than 7 μC/g, an electrophotographic fog appears. As is well known, the appearance of an electrophotographic fog is caused by a part of the toner that is not charged. Namely, when an average charge density of the toner is less than 7 μC/g, the toner partly includes uncharged toner particles. In general, a developed toner image must have an optical density of more than 1.0, preferably 1.2, before the developed toner image, and therefore the recorded toner image can be evaluated as a visually good image. Also, an appearance of the electrophotographic fog should be eliminated before an excellent quality of the recorded toner image can be obtained. Accordingly, it is necessary to give a developer or toner an average charge density of from about 7 to about 20 μC/g, preferably about 7 to about 17 μC/g.

Figure 5:
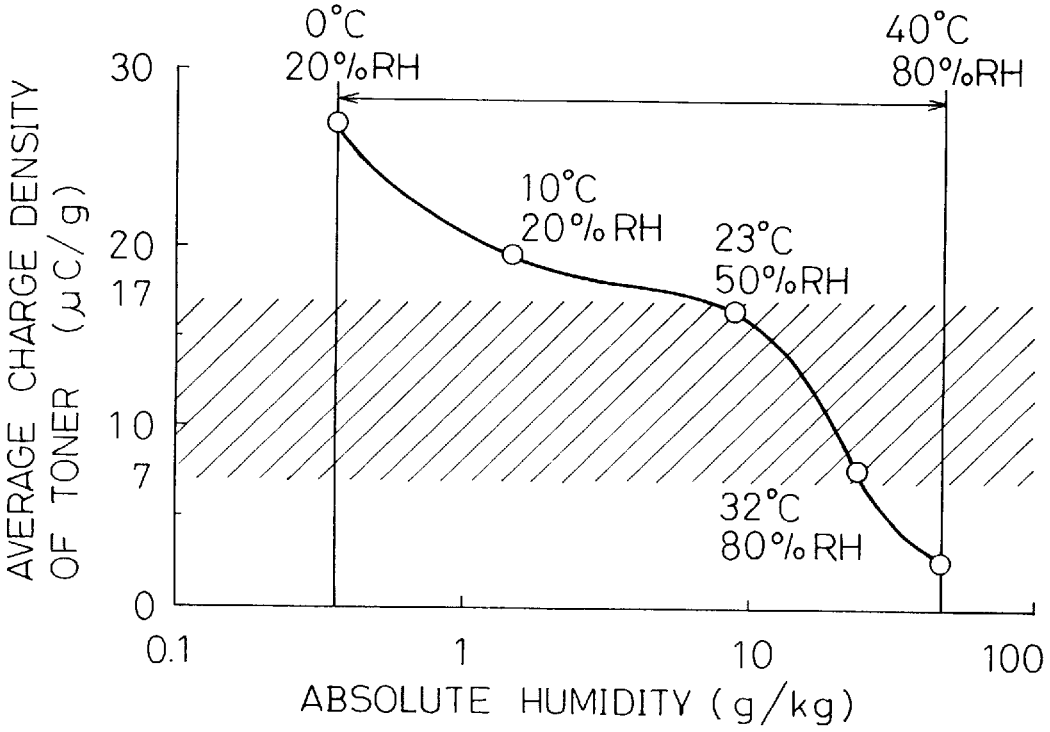
FIG. 5 is a graph showing a relationship between an absolute humidity (g/kg) and an average charge density ($\mu$C/g) of a toner component of a two-component developer when the toner component is electrically charged with a magnetic component thereof by a triboelectrification therebetween.

In a developing device using a two-component developer, when a toner component of the two-component developer is charged by a triboelectrification with a magnetic component thereof, a charging characteristic of the toner component varies in accordance with variations of the temperature and air moisture content, as shown in a graph of FIG. 5. In this graph, the abscissa indicates an absolute humidity (g/kg), and the ordinate indicates an average charge density (μC/g) of the toner component. Also, the preferable range (7 to 17 μC/g) of the average charge density is shown as a hatched zone. As apparent from the graph of FIG. 5, when a temperature and air moisture content are less than 23° C. and 50% (Relative Humidity), the toner component has an average charge density of more than 17 μC/g, and when a temperature and air moisture content are more than 32° C. and 80% (RH), the toner component has an average charge density of less than 7 μC/g. Accordingly, in the developing device using a two-component developer, it is difficult to obtain a good quality of a recorded toner image when the temperature and air moisture content is less than 23° C. and 50% (RH), and the temperature and air moisture content is more than 32° C. and 80% (RH).

Figure 6:
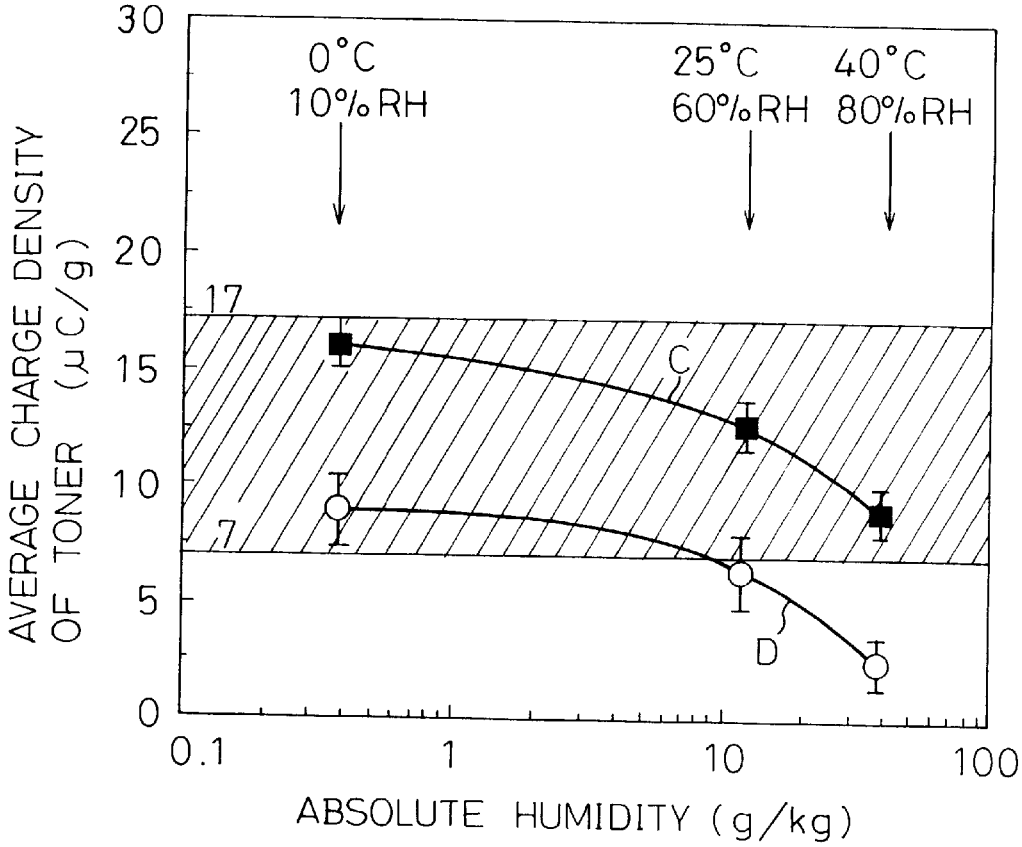
FIG. 6 is a graph showing a relationship between an absolute humidity (g/kg) and an average charge density ($\mu$C/g) of a non-magnetic type one-component developer or toner when a charge-injection effect is utilized for charging the toner, and when a triboelectrification is utilized for the same purpose.

FIG. 6 is graph showing a relationship between an absolute humidity (g/kg) and an average charge density (μC/g) of a non-magnetic type one-component developer or toner when a charge-injection effect is utilized for charging the toner, and when a triboelectrification is utilized for the same purpose. In this graph, a curve D represents a charging characteristic derived from the triboelectrification, and a curve C represents a charging characteristic derived from the charge-injection effect. As apparent from the graph of FIG. 6, the curve C (charge-injection effect) falls within the preferable range of from about 7 to about 17 μC/g shown by hatching, regardless of the variations of a temperature and air moisture content, but the curve D (triboelectrification) is separated from the preferable range at the temperature of 25° C. and moisture content 60% (RH).

Figure 7:
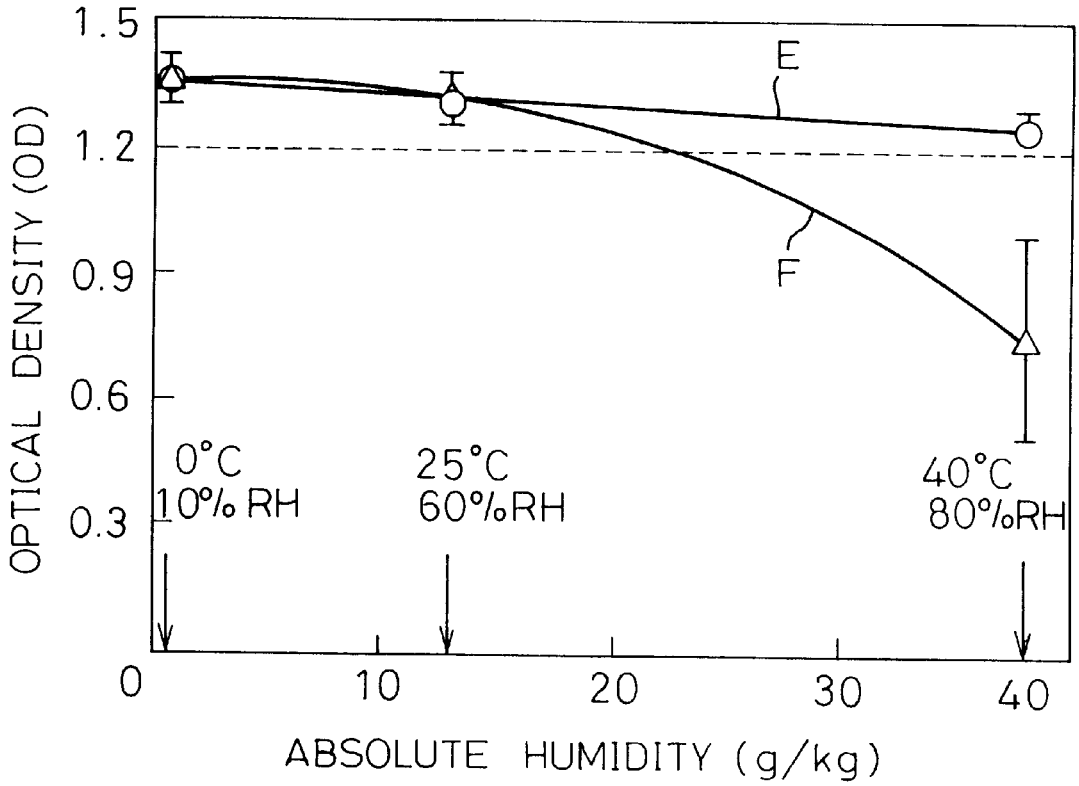
FIG. 7 is a graph showing a relationship between an absolute humidity (g/kg) and an optical density of a transferred toner image when a conductive roller type transfer charger is used for a toner image transferring process, and when a corona discharger is used for the same process.

FIG. 7 is a graph showing a relationship between an absolute humidity (g/kg) and an optical density of a transferred toner image when a conductive roller type transfer charger is used for a toner image transferring process, and when a corona discharger is used for the same process. In this graph, a curve E represents a transferring characteristic derived from the conductive roller type transfer charger, and a curve F represents a transferring characteristic derived from the corona discharger. Note, since an optical density of a transferred toner image is proportional to a toner transfer efficiency defined hereinbefore, a quality of an transferred toner image can be evaluated by an optical density thereof. As apparent from the graph of FIG. 7, when the conductive roller type transfer charger is used, the transferred toner image has an optical density of more than 1.2, regardless of variations of the temperature and air moisture content, but when the corona discharger is used, the transferred toner image has an optical density of less than 1.2 even under a high temperature and high air moisture content. In general, the transferred toner image must have an optical density of more than 1.2 before the transfer of the toner image, and therefore, the recorded toner image can be evaluated as a visual good image.

Figure 8:
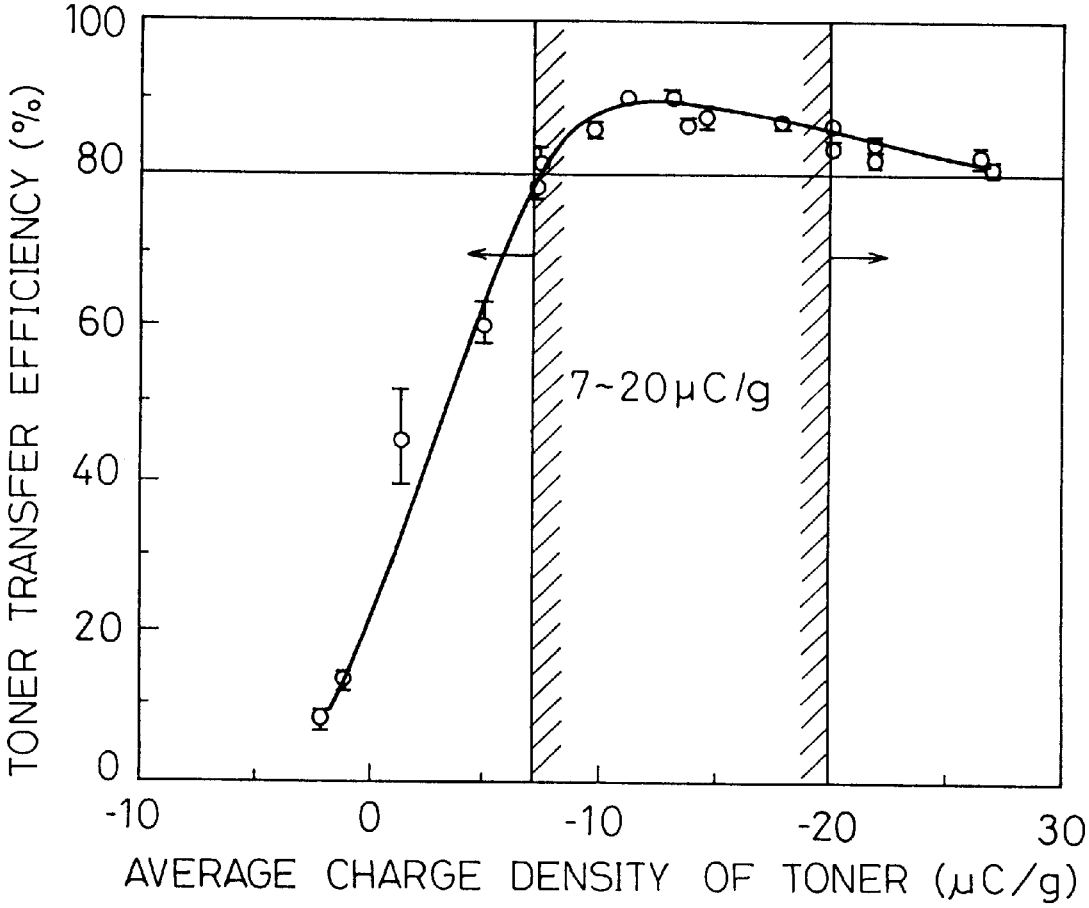
FIG. 8 is a graph showing a relationship between an average charge density of a one-component developer or toner and a toner transfer efficiency when a conductive roller type transfer charger is used for a toner image transferring process.

FIG. 8 is a graph showing a relationship between an average charge density of a one-component developer or toner and a toner transfer efficiency when a conductive roller type transfer charger is used for a toner image transferring process. As apparent from this graph, the toner must have an average charge density of about from 7 to about 17 ($\mu$C/g) before a toner transfer efficiency of more than 80% can be obtained. Note, in general, a toner transfer efficiency of more than 80% can be evaluated as good.

Finally, it will be understood by those skilled in the art that the foregoing description is of preferred embodiments of the present invention, and that various changes and modifications can be made without departing from the spirit and scope thereof.

What is claimed is:

1. An electrophotographic recording apparatus, comprising:

a photosensitive body;

a conductive contacting type charger for producing an electrically-charged area on said photosensitive body;

an optical writer for forming an electrostatic latent image on the electrically-charged area of said body;

a developer for electrostatically developing the electrostatic latent image of said body in an environment of 20–80% (g/kg) relative humidity as a charged visible image with an electrostatically-charged one-component developer; and a transfer member for electrostatically transferring the charged visible image developed by said developer from said body to a recording medium in an environment of 20–80% (g/kg) relative humidity, wherein the optical density of the transferred image is greater than 1.2, wherein the developer transfer efficiency is greater than about 80%, wherein said developer includes a conductive developing roller member for entraining the developer to form a developer layer therearound and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, and wherein said transfer member includes a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member.

2. The apparatus as set forth in claim 1, wherein said developing roller member is a conductive foam rubber roller member, and said regulating blade member is a conductive stainless steel plate member.

3. The apparatus as set forth in claim 1, wherein said conductive transfer roller member is formed as a conductive foam rubber roller member.

4. The apparatus as set forth in claim 1, wherein said body is a photosensitive drum.

5. The apparatus as set forth in claim 1, wherein said conductive contacting type charger is a conductive rotary brush type charger.

6. The apparatus as set forth in claim 5, wherein said developing roller member is a conductive foam rubber roller member, and said regulating blade member is a conductive stainless steel plate member.

7. The apparatus as set forth in claim 5, wherein said conductive transfer roller member is a conductive foam rubber roller member.

8. An electrophotographic recording apparatus, comprising:

a photosensitive body;

a conductive contacting type charger for producing an electrically-charged area on said photosensitive body;

an optical writer for forming an electrostatic latent image on the electrically-charged area of said body;

a developer for electrostatically developing the electrostatic latent image of said body in an environment of 20–80% (g/kg) relative humidity as a charged visible image with an electrostatically-charged one-component developer; and a transfer member for electrostatically transferring the charged visible image developed by said developer from said body to a recording medium in an environment of 20–80% (g/kg) relative humidity, wherein the developer transfer efficiency is greater than about 80%, wherein said developer includes a conductive developing roller member for entraining the developer to form a developer layer therearound and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, wherein said transfer member includes a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member, and wherein an optical density of the transferred image is greater than 1.2.

9. An electrophotographic recording apparatus, comprising:

a photosensitive body;

a conductive contacting type charger for producing an electrically-charged area on said photosensitive body;

an optical writer for forming an electrostatic latent image on the electrically-charged area of said body;

a developer for electrostatically developing the electrostatic latent image of said body in an environment of 20–80% (g/kg) relative humidity as a charged visible image with an electrostatically-charged one-component developer; and a transfer member for electrostatically transferring the charged visible image developed by said developer from said body to a recording medium in an environment of 20–80% (g/kg) relative humidity, wherein the developer transfer efficiency is greater than about 80%, wherein said developer includes a conductive developing roller member for entraining the developer to form a developer layer therearound and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, wherein said transfer member includes a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member, and wherein an average charge density for the developer is in the range of 7–17 $\mu$C/g.

10. A method for operating an electrophotographic recording apparatus, comprising the steps of:

providing a photosensitive body;

using a conductive contacting type charger for electrically-charging an area on said photosensitive body;

forming an electrostatic latent image on the electrically-charged area of said body;

electrostatically developing the electrostatic latent image of said body in an environment of 20–80% (g/kg) relative humidity as a charged visible image with an electrostatically-charged one-component developer; and electrostatically transferring the charged visible image from said body to a recording medium in an environment of 20–80% (g/kg) relative humidity, so that the developer transfer efficiency is greater than about 80%, wherein the optical density of the transferred image is greater than 1.2, wherein said developing step includes using a conductive developing roller member for entraining the developer to form a developer layer around the body, and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, and wherein said transferring step includes using a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member.

11. The method as set forth in claim 10, further comprising the step of forming said developing roller member as a conductive foam rubber roller member, and said regulating blade member as a conductive stainless steel plate member.

12. The method as set forth in claim 10, further comprising the step of forming said conductive transfer roller member as a conductive foam rubber roller member.

13. The method as set forth in claim 10, further comprising the step of forming said body as a photosensitive drum.

14. The method as set forth in claim 10, further comprising the step of forming said conductive contacting type charger as a conductive rotary brush type charger.

15. The method as set forth in claim 14, further comprising the step of forming said developing roller member as a conductive foam rubber roller member, and said regulating blade member as a conductive stainless steel plate member.

16. The method as set forth in claim 15, further comprising the step of forming said conductive transfer roller member as a conductive foam rubber roller member.

17. A method for operating an electrophotographic recording apparatus, comprising the steps of:

providing a photosensitive body;

using a conductive contacting type charger for electrically-charging an area on said photosensitive body;

forming an electrostatic latent image on the electrically-charged area of said body;

electrostatically developing the electrostatic latent image of said body in an environment of 20–80% (g/kg) relative humidity as a charged visible image with an electrostatically-charged one-component developer; and electrostatically transferring the charged visible image from said body to a recording medium in an environment of 20–80% (g/kg) relative humidity, so that the developer transfer efficiency is greater than about 80%, wherein said developing step includes using a conductive developing roller member for entraining the developer to form a developer layer around the body, and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, wherein said transferring step includes using a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member, and wherein the electrostatic transferring step provides an optical density of the transferred image greater than 1.2.

18. A method for operating an electrophotographic recording apparatus, comprising the steps of:

providing a photosensitive body;

using a conductive contacting type charger for electrically-charging an area on said photosensitive body;

forming an electrostatic latent image on the electrically-charged area of said body;

electrostatically developing the electrostatic latent image of said body in an environment of 20–80% (g/kg) relative humidity as a charged visible image with an electrostatically-charged one-component developer; and electrostatically transferring the charged visible image from said body to a recording medium in an environment of 20–80% (g/kg) relative humidity, so that the developer transfer efficiency is greater than about 80%, wherein said developing step includes using a conductive developing roller member for entraining the developer to form a developer layer around the body, and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, wherein said transferring step includes using a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member, and wherein an average charge density for the developer is in the range of 7–17 $\mu$C/g.

19. An electrophotographic recording apparatus, comprising:

a photosensitive body means;

conductive contacting type charger means for producing an electrically-charged area on said photosensitive body means;

optical writing means for forming an electrostatic latent image on the electrically-charged area of said body means;

developing means for electrostatically developing the electrostatic latent image of said body means in an environment of 20–80% (g/Kg) relative humidity as a charged visible image with an electrostatically-charged one-component developer; and transferring means for electrostatically transferring the charged visible image developed by said developing means from said body means to a recording medium in an environment of 20–80% (g/Kg) relative humidity, wherein the developing means transfer efficiency is greater than about 80%, wherein said developing means includes a conductive developing roller member for entraining the developer to form a developer layer therearound and for bringing the developer layer to said body means for the development of the latent image, a conductive regulating blade member resiliently engaged with said developing roller for uniformly regulating a thickness of the developer layer formed therearound, and a charge injection effect means for electrically charging the developer layer by applying a developer bias voltage to said conductive developing roller member and electric energy to said regulating blade member, and wherein said transferring means includes a conductive transfer roller member in contact with said body means, and an electric source for applying an electric energy to said conductive transfer roller member to give the recording medium an electric charge having a polarity opposite to that of the charged visible image, during a passage of the recording medium through a nip between said body means and said conductive transfer roller member, wherein said developing roller member is formed as a conductive foam rubber roller member, and said regulating blade member is formed as a conductive stainless steel plate member, wherein said conductive transfer roller member is formed as a conductive foam rubber roller member, wherein said conductive contacting type charger means is formed as a conductive rotary brush type charger, and wherein an optical density of the transferred image is greater than 1.2.

20. An electrophotographic recording apparatus as set forth in claim 5, wherein said developing roller member is formed as a conductive foam rubber roller member, and said regulating blade member is formed as a conductive stainless steel plate member.

21. An electrophotographic recording apparatus as set forth in claim 19, wherein said conductive transfer roller member is formed as a conductive foam rubber roller member.

22. An electrophotographic recording apparatus, comprising:

a photosensitive body;

a conductive contacting type charger for producing an electrically-charged area on said photosensitive body;

an optical writer for forming an electrostatic latent image on the electrically-charged area of said body;

a developer for electrostatically developing the electrostatic latent image of said body in an environment of 20–80% (g/kg) relative humidity as a charged visible image with an electrostatically-charged one-component developer; and a transfer member for electrostatically transferring the charged visible image developed by said developer from said body to a recording medium in an environment of 20–80% (g/kg) relative humidity wherein the optical density of the transferred image is greater than 1.2, wherein the developer transfer efficiency is greater than about 80%, wherein said developer includes a conductive developing roller member for entraining the developer to form a developer layer therearound and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, wherein an average charge density for the developer is in the range of 7–17 $\mu$C/g, and wherein said transfer member includes a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member.

23. The apparatus as set forth in claim 22, wherein said developing roller member is a conductive foam rubber roller member, and said regulating blade member is a conductive stainless steel plate member.

24. The apparatus as set forth in claim 22, wherein said conductive transfer roller member is formed as a conductive foam rubber roller member.

25. The apparatus as set forth in claim 22, wherein said body is a photosensitive drum.

26. The apparatus as set forth in claim 22, wherein said conductive contacting type charger is a conductive rotary brush type charger.

27. The apparatus as set forth in claim 26, wherein said developing roller member is a conductive foam rubber roller member, and said regulating blade member is a conductive stainless steel plate member.

28. The apparatus as set forth in claim 26, wherein said conductive transfer roller member is a conductive foam rubber roller member.

29. A method for operating an electrophotographic recording apparatus, comprising the steps of:

providing a photosensitive body;

using a conductive contacting type charger for electrically-charging an area on said photosensitive body;

forming an electrostatic latent image on the electrically-charged area of said body;

electrostatically developing the electrostatic latent image of said body in an environment of 20–80% (g/kg) relative humidity as a charged visible image with an electrostatically-charged one-component developer; and electrostatically transferring the charged visible image from said body to a recording medium in an environment of 20–80% (g/kg) relative humidity, so that the optical density of the transferred image is greater than 1.2, and so that the developer transfer efficiency is greater than about 80%, wherein said developing step includes using a conductive developing roller member for entraining the developer to form a developer layer around the body, and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, so that the average charger density for the developer is in the range of 7–17 $\mu$C/g, and wherein said transferring step includes using a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member.

30. The method as set forth in claim 29, further comprising the step of forming said developing roller member as a conductive foam rubber roller member, and said regulating blade member as a conductive stainless steel plate member.

31. The method as set forth in claim 29, further comprising the step of forming said conductive transfer roller member as a conductive foam rubber roller member.

32. The method as set forth in claim 29, further comprising the step of forming said body as a photosensitive drum.

33. The method as set forth in claim 29, further comprising the step of forming said conductive contacting type charger as a conductive rotary brush type charger.

34. The method as set forth in claim 33, further comprising the step of forming said developing roller member as a conductive foam rubber roller member, and said regulating blade member as a conductive stainless steel plate member.

35. The method as set forth in claim 33, further comprising the step of forming said conductive transfer roller member as a conductive foam rubber roller member.

36. An electrophotographic recording apparatus, comprising:

a photosensitive body;

a conductive contacting type charger for producing an electrically-charged area on said photosensitive body;

an optical writer for forming an electrostatic latent image on the electrically-charged area of said body;

a developer for electrostatically developing the electrostatic latent image of said body in an environment of 20–80% (g/kg) relative humidity as a charged visible image with an electrostatically-charged one-component developer; and a transfer member for electrostatically transferring the charged visible image developed by said developer from said body to a recording medium in an environment of 20–80% (g/kg) relative humidity, wherein the developer transfer efficiency is greater than about 80%, wherein said developer includes a conductive developing roller member for entraining the developer to form a developer layer therearound and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, wherein an average charge density for the developer is in the range of 7–17 $\mu$C/g, and wherein said transfer member includes a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member.

37. The apparatus as set forth in claims 36, wherein said developing roller member is a conductive foam rubber roller member, and said regulating blade member is a conductive stainless steel plate member.

38. The apparatus as set forth in claim 36, wherein said conductive transfer roller member is formed as a conductive foam rubber roller member.

39. The apparatus as set forth in claim 36, wherein said body is a photosensitive drum.

40. The apparatus as set forth in claim 36, wherein said conductive contacting type charger is a conductive rotary brush type charger.

41. The apparatus as set forth in claim 40, wherein said developing roller member is a conductive foam rubber roller member, and said regulating blade member is a conductive stainless steel plate member.

42. The apparatus as set forth in claim 40, wherein said conductive transfer roller member is a conductive foam rubber roller member.

43. An electrophotographic recording apparatus as set forth in claim 40, wherein said developing roller member is formed as a conductive foam rubber roller member, and said regulating blade member is formed as a conductive stainless steel plate member.

44. A method for operating an electrophotographic recording apparatus, comprising the steps of:

providing a photosensitive body;

using a conductive contacting type charger for electrically-charging an area on said photosensitive body;

forming an electrostatic latent image on the electrically-charged area of said body;

electrostatically developing the electrostatic latent image of said body in an environment of 20–80% (g/kg) relative humidity as a charged visible image with an electrostatically-charged one-component developer; and electrostatically transferring the charged visible image from said body to a recording medium in an environment of 20–80% (g/kg) relative humidity, so that the developer transfer efficiency is greater than about 80%, wherein said developing step includes using a conductive developing roller member for entraining the developer to form a developer layer around the body, and for bringing the developer layer to said body for the development of the latent image, a conductive regulating blade member resiliently engaged with said developing roller for uniformly regulating a thickness of the developer layer formed therearound, and a charge injection effect member for electrically charging the developer layer by applying a developer bias voltage to said conductive developing roller member and electric energy to said regulating blade member, wherein an average charge density for the developer is in the range of 7–17 $\mu$C/g, and wherein said transferring step includes using a conductive transfer roller member in contact with said body, and an electric source for applying an electric energy to said conductive transfer roller member to give the recording medium an electric charge having a polarity opposite to that of the charged visible image, during a passage of the recording medium through a nip between said body and said conductive transfer roller member.

45. The method as set forth in claim 40, further comprising the step of forming said developing roller member as a conductive foam rubber roller member, and said regulating blade member as a conductive stainless steel plate member.

46. The method as set forth in claim 40, further comprising the step of forming said conductive transfer roller member as a conductive foam rubber roller member.

47. The method as set forth in claim 40, further comprising the step of forming said body as a photosensitive drum.

48. The method as set forth in claim 40, further comprising the step of forming said conductive contacting type charger as a conductive rotary brush type charger.

49. The method as set forth in claim 48, further comprising the step of forming said developing roller member as a conductive foam rubber roller member, and said regulating blade member as a conductive stainless steel plate member.

50. The method as set forth in claim 48, further comprising the step of forming said conductive transfer roller member as a conductive foam rubber roller member.

* * * * *